United States Patent [19]

De Cesari

[11] 4,249,185

[45] Feb. 3, 1981

[54] PORTABLE, COLLAPSIBLE CUBICAL QUAD ANTENNA

[76] Inventor: Robert J. De Cesari, 3941 Mt. Brundage Ave., San Diego, Calif. 92111

[21] Appl. No.: 30,090

[22] Filed: Apr. 16, 1979

[51] Int. Cl.[3] ..... H01Q 7/02; H01Q 1/08

[52] U.S. Cl. ..... 343/871; 343/881

[58] Field of Search ..... 343/871, 880, 881, 882

[56] References Cited

U.S. PATENT DOCUMENTS

| | | | |
|---|---|---|---|
| 1,556,725 | 10/1925 | Shallcross | 343/871 |
| 1,626,803 | 5/1927 | Fishback | 343/702 |
| 1,683,270 | 9/1928 | Taylor et al. | 343/880 |
| 1,684,262 | 9/1928 | Clinker | 343/871 |
| 1,852,925 | 4/1932 | Gomery | 343/881 |
| 3,107,353 | 10/1963 | Fox | 343/881 |
| 4,138,682 | 2/1979 | Doherty | 343/871 |

*Primary Examiner*—Eli Lieberman

*Attorney, Agent, or Firm*—Henri J. A. Charmasson

[57] ABSTRACT

A portable and collapsible supporting structure for a multi-element quad antenna comprising a horizontal telescopic boom upon which are mounted several sets of folding spreader arms radiating from the boom, each arm being pivotally connected to it. Each set of spreader arms can be immobilized in a common angular position with the boom, whereby several quadrangular loops may be hung between said spreader arms. The boom is supported by a multi-element mast. The mast itself rests on the hollow cylindrical base which doubles as a sheath for the storage and transporation of the various dismantled elements of the structure.

2 Claims, 16 Drawing Figures

FIG. 12
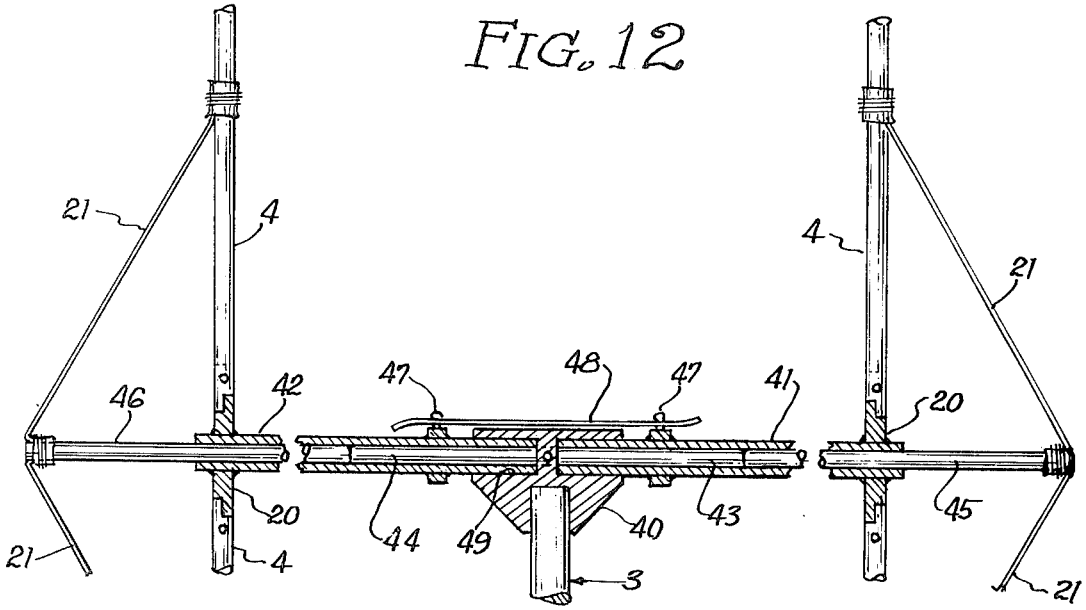
FIG. 13
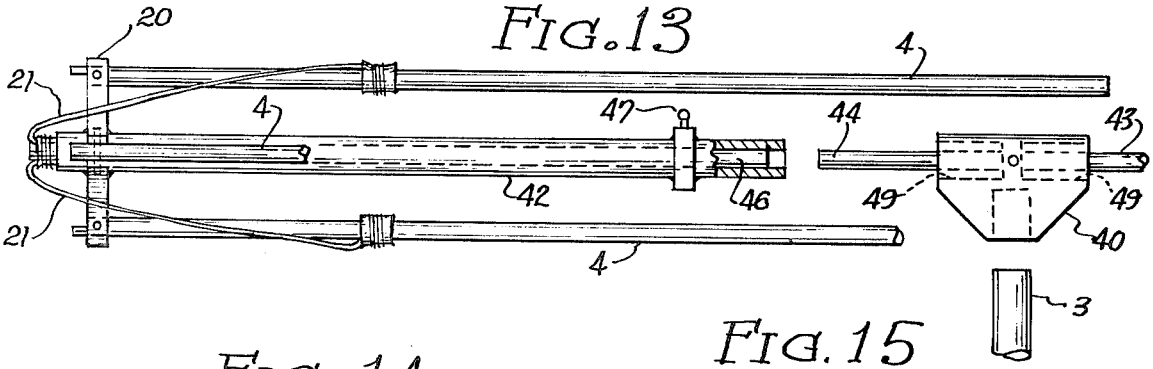
FIG. 14
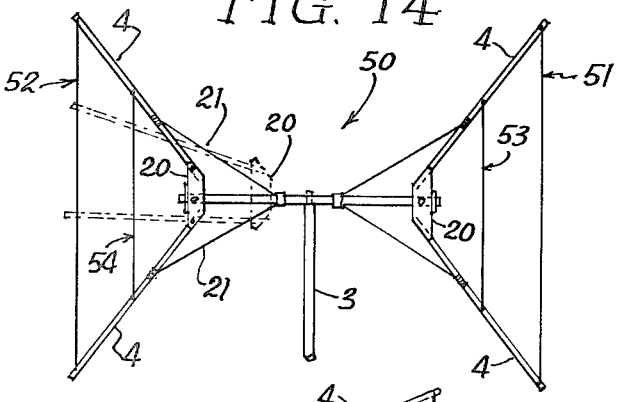
FIG. 15
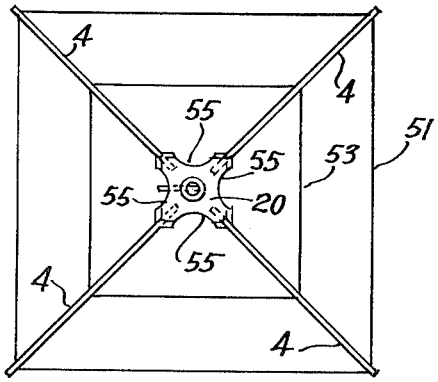
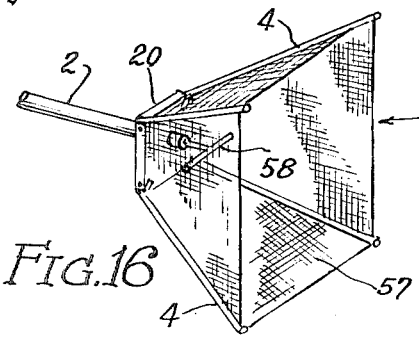
FIG. 16

PORTABLE, COLLAPSIBLE CUBICAL QUAD ANTENNA

BACKGROUND OF THE INVENTION

The "cubicle quad" or, simply, "quad" antenna, is well known among those skilled in the art of radio communication and consists of a pair of square loops, one quarter wavelength on a side or one-wavelength around the periphery, one loop being driven and the other used as a parasitic reflector. Its gain is roughly comparable with that of a three-element yagi antenna of ordinary design. Three-elements arrangements have also been used in which the first loop is called the director, the central loop connected to the feed line is called the radiator, and the third loop is called the reflector. The principal advantages of the quad antenna are seen in the fact that it is light in weight, relatively inexpensive to build, and requires shorter elements than the standard antenna. For instance, in the fourteen megacycle band the normally required thirty-three feet (9.9 meters) yagi array may be replaced by a quad having a width of only eighteen feet (5.4 meters) and boom length of only twelve feet (3.6 meters). However, the quad has the disadvantage of requiring a very cumbersome structural frame. To this day its application to portable or mobile radio installations has been rather limited. What is needed is a portable supporting structure for a quad antenna which can be quickly and easily assembled or disassembled. Such a device would be ideal for field use by military personnel, police, fire fighters, not to mention ham radio enthusiasts. A self-deploying version of such an antenna would find application in the space exploration program.

SUMMARY OF THE INVENTION

The principal object of this invention is to provide a portable and collapsible radio quad antenna.

Another object of this invention is to provide a quad antenna which can be easily and quickly assembled and disassembled.

A further object of the invention is to provide a collapsible quad antenna which can be stored into a light and compact package for transportation.

Another object of the invention is to provide quad antenna frame which can be made from inexpensive materials and components.

An additional object of this invention is to provide a collapsible supporting frame for a radio quad antenna which can be extended to include multiple elements.

It is also the object of this invention to provide a collapsible supporting frame upon which can be strung various quad elements forming a multiband radio antenna.

Yet another object of this invention is to provide a quad radio antenna frame which can be rotated both in the horizontal and vertical directions in order to optimize the polarization and directionality of the antenna.

These and other purposes are achieved by a portable and collapsible supporting structure for a multi-element quad antenna formed by a horizontal, telescopic boom upon which are mounted several sets of folding arms pivotally connected to the boom. Each set of arms can be immobilized in a common angular position with the boom whereby several quadrangular loops may be hung between said arms. The boom is supported by a multi-element mast and the mast itself rests on a cylindrical base which is also used as a storage compartment for the various elements of the antenna.

BRIEF DESCRIPTION OF THE DRAWINGS

FIG. 12 FIG. 12 is a partial front view of a third embodiment of the invention with a portion of the boom cut away to show the arm-spreading mechanism;

FIG. 13 is a frontal view of a half section of the third embodiment shown in the folded position;

FIG. 14 is a front elevation of a fourth embodiment of the invention supporting a multi-band quad antenna;

FIG. 15 is a right side view of the fourth embodiment of the invention;

FIG. 16 is a perspective view of a fifth embodiment of the invention supporting a microwave horn.

DESCRIPTION OF THE PREFERRED EMBODIMENTS OF THE INVENTION

Figure 1:
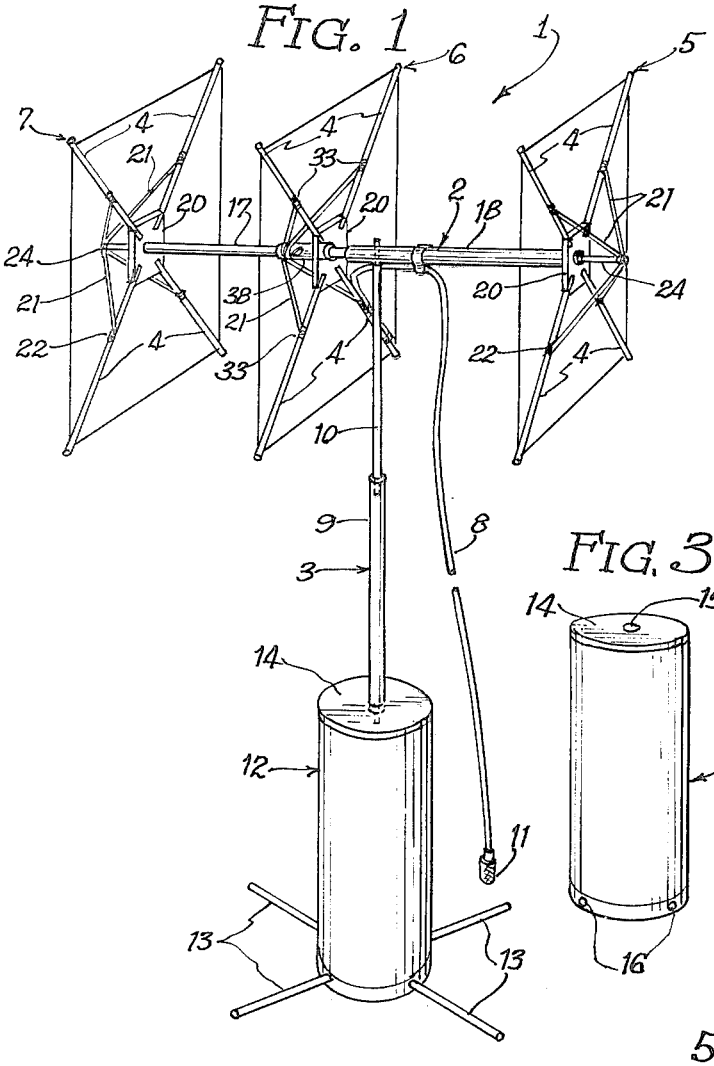
FIG. 1 is a perspective view of the preferred embodiment of the invention shown in the deployed position.
Figure 2:
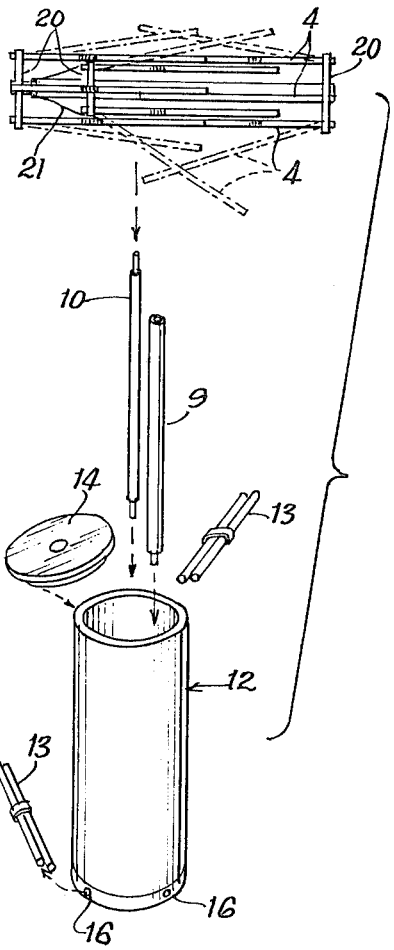
FIG. 2 is a perspective view showing the various elements of the structure illustrated in FIG. 1 dismantled and ready for storage.
Figure 3:
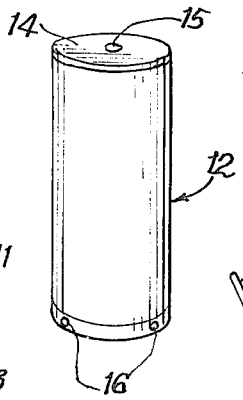
FIG. 3 is a front elevational view of the antenna base used a a storage container.

Referring now to the drawing and in accordance with the invention, there is shown in FIG. 1 a first embodiment 1 of the invention supporting a three elements quad antenna. The structure 1 is remarkable in that it is made of various elements which can be disassembled, or folded, then stowed, into the base enclosure 12 for storage or transportation as illustrated in FIG. 2. The cylindrical base 12 is closed at the bottom and has four small rods 13 projecting horizontally outward from the base 12. The rods 13 are designed to improve the stability of the structure 1 while the antenna is in use. These rods 13 can be extracted from their nesting holes 16 and stored in the enclosure 12 with the other elements of the structure. The removable led 14 on top of the enclosure 12 has a hole 15 in its center designed to receive a mast 3. The mast 3 is made of two interlocking elements 9 and 10. The upper element 10 supports a boom 2 which is orthogonally engaged around its upper tip 34. The boom 2 comprises two elements 17 and 18 which are coaxially engaged into one another as specifically illustrated in FIG. 6. Two sets of matching transversal holes 35 and 36 can be used alternately to mount the boom 2 on the tip 34 of the upper mast element 10. The holes 35 and 36 being orthogonal to one another, the boom 2 can be conveniently rotated in order that the polarization of the antenna matches the polarization of the transmitter. The first embodiment 1 supports three antenna loops 5, 6 and 7. The first loop 5 is called the director and is usually oriented toward the transmitting station. The second loop 6 constitutes the driven element of the antenna or radiator and is connected through a coaxial cable 8 to a transceiver. The third loop 7 acts a parastic reflector. Each loop is supported by a set four spreader arms 4. Each set of spreader arms 4 converge toward a supporting hub plate 20 concentrically and orthogonally engaged around the boom 2. As more specifically illustrated in FIGS. 4 and 5, each hub plates is formed by a flat square element 20 having an indentation 27 at each corner. The end 26 of a spreader arm 4 is pivotally attached into each indentation 27 by a pin 28. It can now be understood that each set of spreader arms 4 can be rotated around the hub plate 20 to various angular positions with the boom 2.

Figure 4:
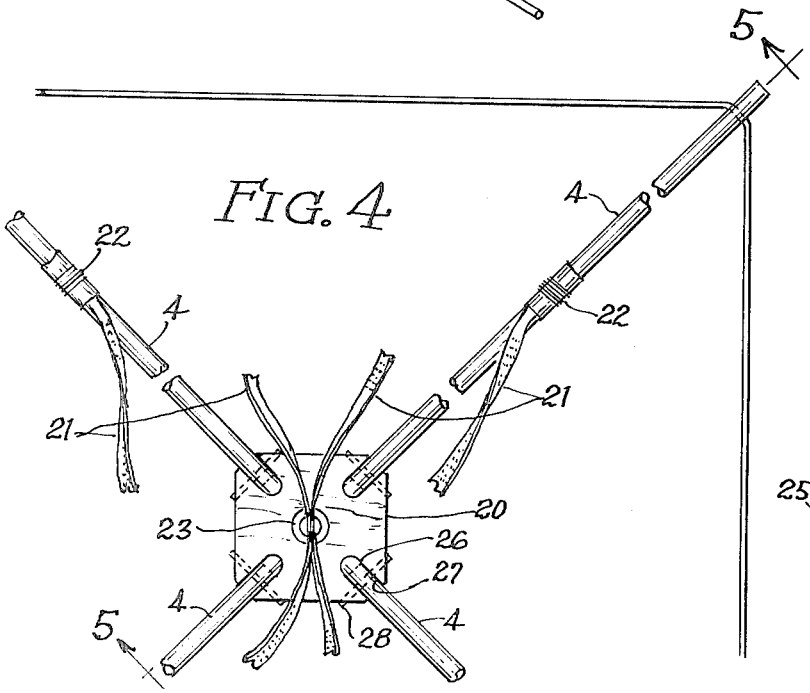
FIG. 4 is a detailed view of the structure used to connect the spreader arms to the antenna boom.
Figure 5:
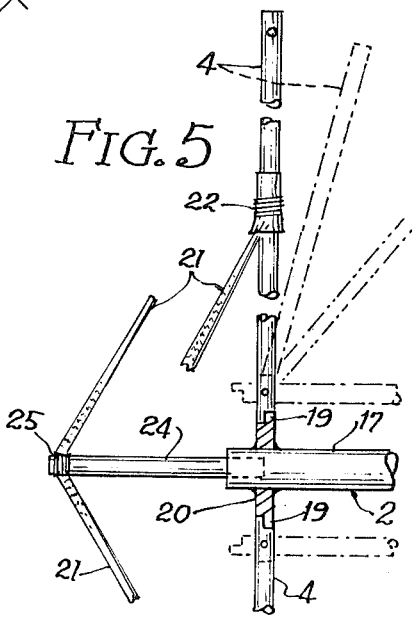
FIG. 5 is a cross sectional view taken along line 5—5 of FIG. 4.
Figure 6:
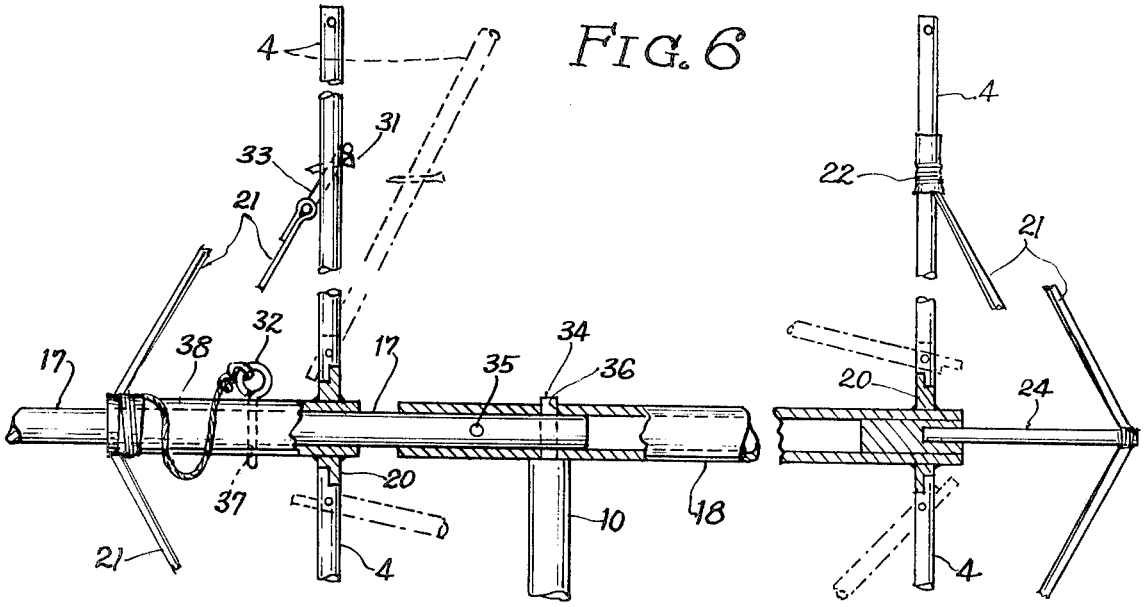
FIG. 6 is a detailed view of the boom with a partial cut out part illustrating the assembly of the boom elements.
Figure 7:
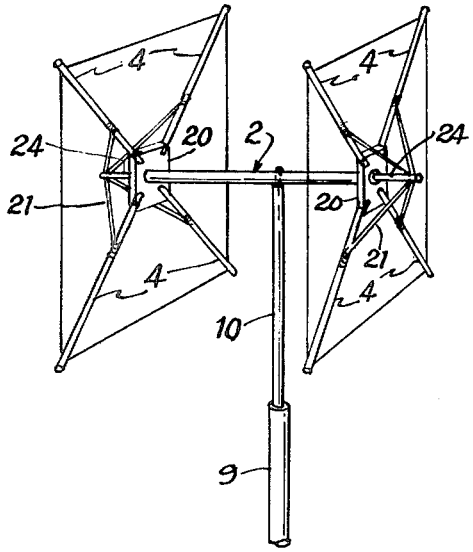
FIG. 7 is a perspective view of a second embodiment of the invention.
Figure 8:
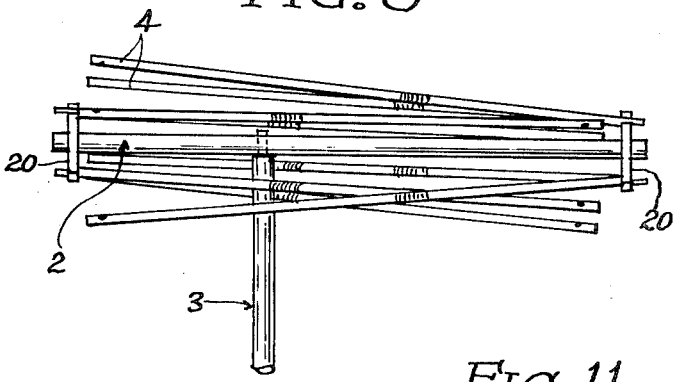
FIG. 8 is a front view of the second embodiment of the invention showing the spreader arm in the collapsed position.
Figure 9:
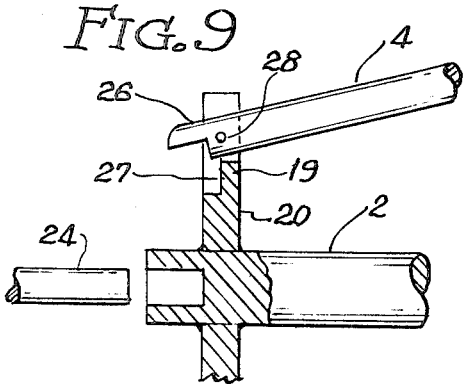
FIG. 9 is a detailed view of the pivotal connection of a spreader arm with the boom.
Figure 10:
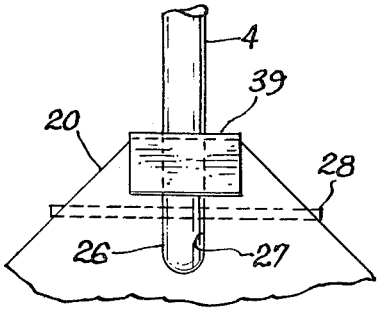
FIG. 10 is a front view of a clamping device used to immobilize the spreader arms.
Figure 11:
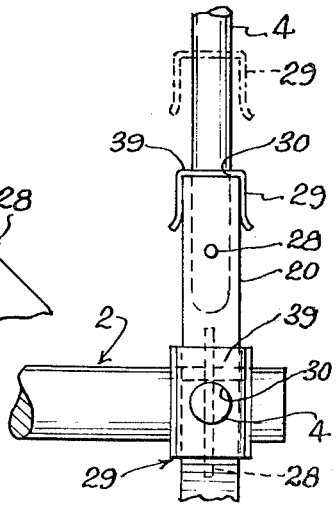
FIG. 11 is a side view of the clamping device shown in FIG. 10.

As illustrated in FIG. 9, a barrier 19 located across the lower part of each indentation 27 limits the travel of the lower end 26 of the spreader arm 4. As shown in FIGS. 4 and 5, straps 21 connected to each spreader arm 4 at point 22 are also connected to the end 25 of a tension stick 24. The tension stick 24 has its opposite end engaged into the extremity of the boom 2. An alternate mode of attachment for the straps 21 is illustrated in the left portion of FIG. 6. This latter type of attachment is more particularly applicable to the elements supporting the driven loop 6 located near the center of the boom 2. In such cases, a loop 33 at the end of each strap 21 is engaged around the spreader arm 4 and hence kept into place by a pin 31 inserted through the spreader arm 4. In both cases, the strap 21 tends to hold the spreader arms 4 their maximum angular position with the boom 2 which is allowed by the barrier 19. The positioning of the driven loop 6 along the boom 2 may be adjusted by sliding the tubular element 38 along the half boom section 17. A pin 32 is used to immobilize the tubular element 38 on the boom 2. An alternate device for immobilizing the spreader arms 4 in a orthogonal position with the boom 2 is illustrated in FIGS. 10 and 11. A U-shaped bracket 29 has a hole 30 in the middle of its base 39 which is engaged on the spreader arm 4. The width of the bracket 29 corresponds to the thickness of the supporting plate 20. The bracket 29 can be slid downward toward the plate 20 until it rests across the identation 27, thus immobilizing the spreader arms 4. FIG. 7 illustrates a second embodiment of the invention supporting a two elements antenna. When not in use, the spreader arms 4 can be collapsed to a folded position as illustrated in FIG. 8. The loops wires (not illustrated) fold back along the boom 2.

A third embodiment of the invention is illustrated in FIGS. 12 and 13. In this third embodiment, the boom 2 comprises a right tubular member 41 and a left tubular member 42 mounted in either side of a yoke 40 supported by the mast 3. Slidingly engaged into the outer end of each tubular elements 41 and 42, is a spreader rod 45 which acts in the same manner as a tension stick 24 of the first embodiment 1 to hold the spreader arms 4 to their maximum angular position with the boom, by means of connecting straps 21. The inward end of each tubular element 41, 42, is engaged around a horizontal pin 43 or 44 projecting from each side of the yoke 40, and nests into a circular cavity 49 surrounding the yoke pin 43 or 44. Upon engagement with the tubular element 41 or 42, the pin 43 or 44, pushes the spreader rod 45 or 46 outward, thus forcing the spreader arms 4 to their maximum angular position with the boom. A tie strap 48 connects the anchor points 47 on each of the two tubular elements 41 and 42, thus immobilizing the structure.

A fourth embodiment 50 of the invention is illustrated in FIGS. 14 and 15. In this configuration 50, each set of spreader arms 4 is immobilized in a angular position with the boom whereby the spreader arms 4 delineate the lateral edges of a pyramid having its apex on the boom 2. A plurality of antenna loops of various sizes can be hung at different intervals across the spreader arms. In this illustration, loops 51 and 52 form a first antenna. The smaller loops 53 and 54 constitute a second antenna with a higher frequency response. The arm supporting hub plate 20, as illustrated in FIG. 15, has additional identations 55 which facilitate the storage of the various elements when they are collapsed and bundled together in the enclosure as shown in FIG. 2. FIG. 16 illustrates a fifths embodiment of the invention in which the pyramid formed by the spreader arms 4 is surrounded with a metallic cloth 57 to form a microwave horn 56 around the bipole antenna element 58.

While I have described the preferred embodiments of my invention and suggested various modifications thereto, other embodiments may be implemented and other changes can be made without departing from the spirit of my invention and from the scope of the appended claims.

The invention claimed is:

1. A foldable frame for supporting an electromagnetic radiation antenna which comprises:

a rigid boom;

at least one set of foldable arms;

means for pivotally connecting the first ends of the foldable arms around the boom in a circular pattern;

means for holding said set of foldable arms in a common angular position with the boom;

a mast having an extremity orthogonally attachable to the boom; and base means for supporting said mast in an upright position, said base means comprising:

a rigid, portable, sealable enclosure which is shaped and dimensioned to form a hand-carrying sheath for housing all of the other components of said foldable frame, and means for mounting the mast above said enclosure, wherein said enclosure comprises:

a hollow cylinder closed at one end, having an inside length greater than the length of the longest of said components;

a removable lid having a hold in its center to receive the lower extremity of the mast, and a plurality of projections extending from the lower part of said cylinder.

2. A foldable frame for supporting an electromagnetic radiation antenna which comprises:

a rigid boom having at least two sections, one of said sections having one end concentrically engaged into one end of another section;

at least one set of foldable arms;

means for pivotally connecting the first ends of the foldable arms around the boom in a circular pattern, said means comprising a flat element concentrically and perpendicularly engaged around the boom, said flat element having a plurality of peripheral indentations, and means for pivotally attaching the end of one of the arms within each indentation;

means for holding said set of foldable arms in a common angular position with the boom;

a mast having an extremity orthogonally attachable to the boom; and base means for supporting said mast in an upright position, said base means comprising a rigid, portable, sealable enclosure which is shaped and dimensioned to form a hand-carryable sheath for housing all other components of said foldable frame, and means for mounting the mast above said enclosure, wherein said enclosure comprises:

a hollow cylinder closed at one end, having an inside length greater than the length of the longest of said components, a removable lid having a hole in its center to receive the lower extremity of the mast; and a plurality of projections extending from the lower part of said cylinder.

* * * * *